US005856742A

United States Patent [19]

Vulih et al.

[11] Patent Number: 5,856,742

[45] Date of Patent: Jan. 5, 1999

[54] TEMPERATURE INSENSITIVE BANDGAP VOLTAGE GENERATOR TRACKING POWER SUPPLY VARIATIONS

[75] Inventors: Salomon Vulih, Meshanic; Stanley Frank Wietecha, South Bound Brook; John A. Olmstead, Cape May Court House; Thomas D. Housten, Somerville, all of N.J.

[73] Assignee: Harris Corporation, Melbourne, Fla.

[21] Appl. No.: 873,902

[22] Filed: Jun. 12, 1997

Related U.S. Application Data

[63] Continuation of Ser. No. 496,965, Jun. 30, 1995, abandoned.

[51] Int. Cl.[6] ..... G05F 3/16; G05F 3/04

[52] U.S. Cl. ..... 323/315; 323/311; 323/901

[58] Field of Search ..... 323/311, 312, 323/313, 314, 315, 316, 901

[56] References Cited

U.S. PATENT DOCUMENTS

| | | | |
|---|---|---|---|
| Re. 30,586 | 4/1981 | Brokaw | 323/314 |
| 3,976,896 | 8/1976 | Ryder | 307/297 |
| 4,085,359 | 4/1978 | Ahmed | 323/22 T |
| 4,087,758 | 5/1978 | Hareyama | 330/261 |
| 4,588,941 | 5/1986 | Kerth et al. | 323/314 |
| 4,633,165 | 12/1986 | Pitekiewicz et al. | 323/314 |
| 4,700,144 | 10/1987 | Thomson | 330/257 |
| 4,714,872 | 12/1987 | Traa | 323/314 |
| 4,812,735 | 3/1989 | Sawada et al. | 323/313 |
| 4,857,823 | 8/1989 | Bitting | 323/314 |
| 4,939,442 | 7/1990 | Carvajal et al. | 323/281 |
| 4,942,369 | 7/1990 | Nakagawara et al. | 330/296 |
| 5,068,594 | 11/1991 | Kurashima | 323/314 |
| 5,144,223 | 9/1992 | Gillingham | 323/313 |
| 5,532,579 | 7/1996 | Park | 323/314 |

OTHER PUBLICATIONS

Marc G. R. Degrauwe et al, CMOS Voltage References Using Lateral BiPolar Transistor, IEEE Journal of Solid State Circuits, Volume SC20, No. 6, Dec. 1985, pp. 1151–1157.

*Primary Examiner*—Peter S. Wong
*Assistant Examiner*—Bao Q. Vu
*Attorney, Agent, or Firm*—Rogers & Killeen

[57] ABSTRACT

A circuit for generating a bandgap voltage that is insensitive to temperature. The circuit includes an amplifier with a feedback loop having a high impedance output current mirror controlled by transistors connected to an output from the amplifier. The current mirror provides proportional currents to a pair of resistors that are connected to inputs to the amplifier, a first input receiving a temperature sensitive voltage from a first of the resistors, and a second input receiving a voltage that is a combination of a temperature sensitive voltage across a second of the resistors and a temperature sensitive offsetting voltage. The second resistor may be tapped to provide a selectable bandgap voltage. A reference voltage for operating the generator may be obtained from a voltage division of supply voltage by two resistors of the same type.

23 Claims, 2 Drawing Sheets

TEMPERATURE INSENSITIVE BANDGAP VOLTAGE GENERATOR TRACKING POWER SUPPLY VARIATIONS

This application is a continuation of Ser. No. 08/496,965 filed Jun. 30, 1995, now abandoned.

BACKGROUND OF THE INVENTION

The present invention is generally directed to a circuit for providing a temperature insensitive voltage, and more particularly to a bandgap voltage generator.

Bandgap voltage generators provide a specific low voltage that is desirably insensitive to temperature. The voltage is typically equal to the bandgap potential of silicon at 0° Kelvin, approximately 1.2 volts, although other low voltages may be provided. The generated voltage is used in variety of applications, including CMOS integrated circuits.

Bandgap generators, such as disclosed in U.S. Pat. No. 5,144,223 to Gillingham, have moved away from the use of amplifiers because of the current they consume, especially in low power operations. The present invention solves the current consumption problem and is able to use an amplifier efficiently in a 5 volt system.

Accordingly, it is an object of the present invention to provide a novel circuit for providing a voltage that is insensitive to temperature that obviates the problems of the prior art.

It is another object of the present invention to provide a novel circuit for generating a bandgap voltage in which a feedback loop for an amplifier includes a high impedance output current mirror for controlling the current across a resistor.

It is yet another object of the present invention to provide a novel bandgap generator in which an amplifier feedback loop includes a high impedance output current mirror for providing proportional currents to a pair of resistors that are connected to the amplifier, where one resistor feeds a temperature sensitive voltage to a first amplifier input, and a voltage is provided to a second amplifier input from a combination of a temperature sensitive voltage across a second transistor from which the bandgap voltage may be tapped and an offsetting voltage.

It is still another object of the present invention to provide a novel circuit for providing a bandgap voltage for a five volt system, the circuit having a pair of bipolar transistors with a common collector and bases connected to a reference voltage source, a first resistor connected in series with an emitter of a first of the bipolar transistors, an amplifier with a first terminal connected to the first resistor and a second terminal connected to an emitter of a second bipolar transistor, a second resistor connected in series with an emitter of the second bipolar transistor, the second resistor being tapped for providing a bandgap voltage, and in which an amplifier feedback loop provides proportional currents to the two resistors.

It is a further object of the present invention to provide a novel circuit for generating a bandgap voltage in which a feedback loop for an amplifier includes a high impedance output current mirror that is controlled by series connected field effect transistors that provide control signals to the gates of field effect transistors in the current mirror.

It is yet a further object of the present invention to provide a novel circuit for generating a bandgap voltage in which a feedback loop for an amplifier includes a current mirror that is controlled by an array of series connected field effect transistors, the current mirror including two pairs of field effect transistors for providing a high impedance output and that have their gates connected to the controlling field effect transistors.

It is still a further object of the present invention to provide a novel circuit for generating a bandgap voltage for biasing an entire semiconductor chip that is insensitive to temperature, and is independent of power supply variations and of trimming of the bandgap.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
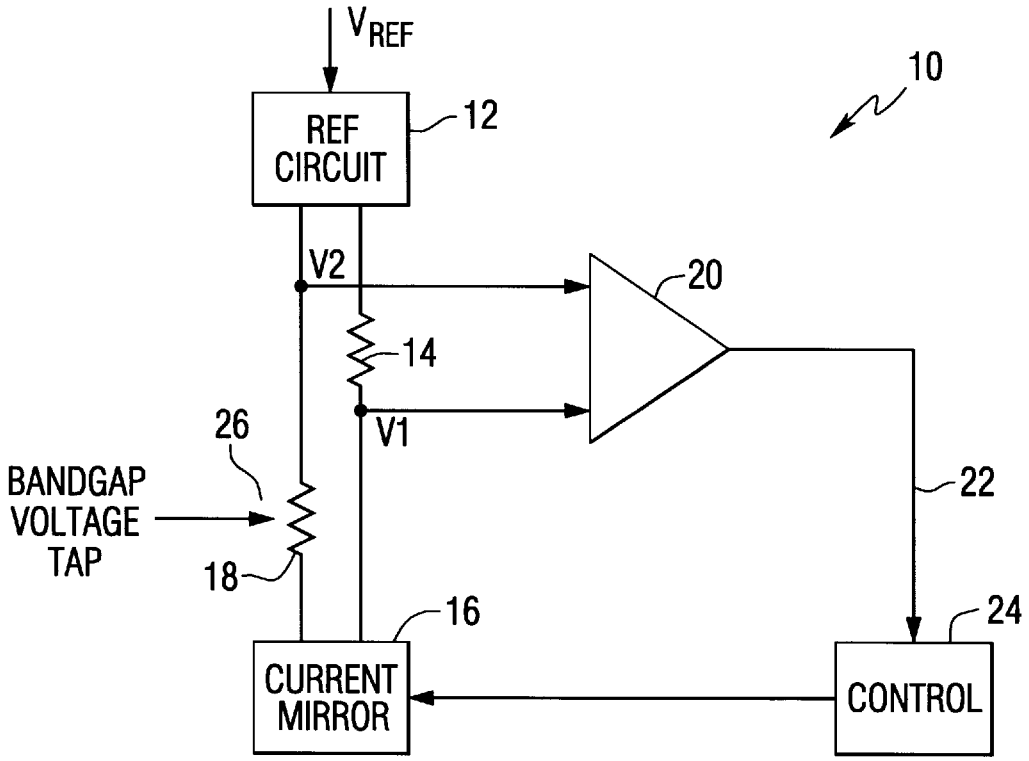
FIG. 1 is a block diagram of an embodiment of the present invention.

With reference now to FIG. 1, an embodiment 10 of the present invention may include a reference circuit 12 for providing a first voltage V1 across a first resistor 14 that has a positive voltage/current temperature coefficient. A negative temperature coefficient base-to-emitter voltage from reference circuit 12 generates a second voltage V2 that is also temperature dependent. An amplifier 20 determines the difference between the first and second voltages V1 and V2 and provides an output that is fed through a feedback loop 22 to current mirror 16. Feedback loop 22 includes a control circuit 24 for enabling high output impedance operation of current mirror 16. The current from resistor 14 is mirrored in current mirror 16 to generate a voltage across a second resistor 18. The voltage drop across second resistor 18 combines with the negative temperature coefficient base-to-emitter voltage from reference circuit 12 so that second resistor 18 may be tapped with tap 26 to provide the desired temperature insensitive bandgap voltage.

Figure 2:
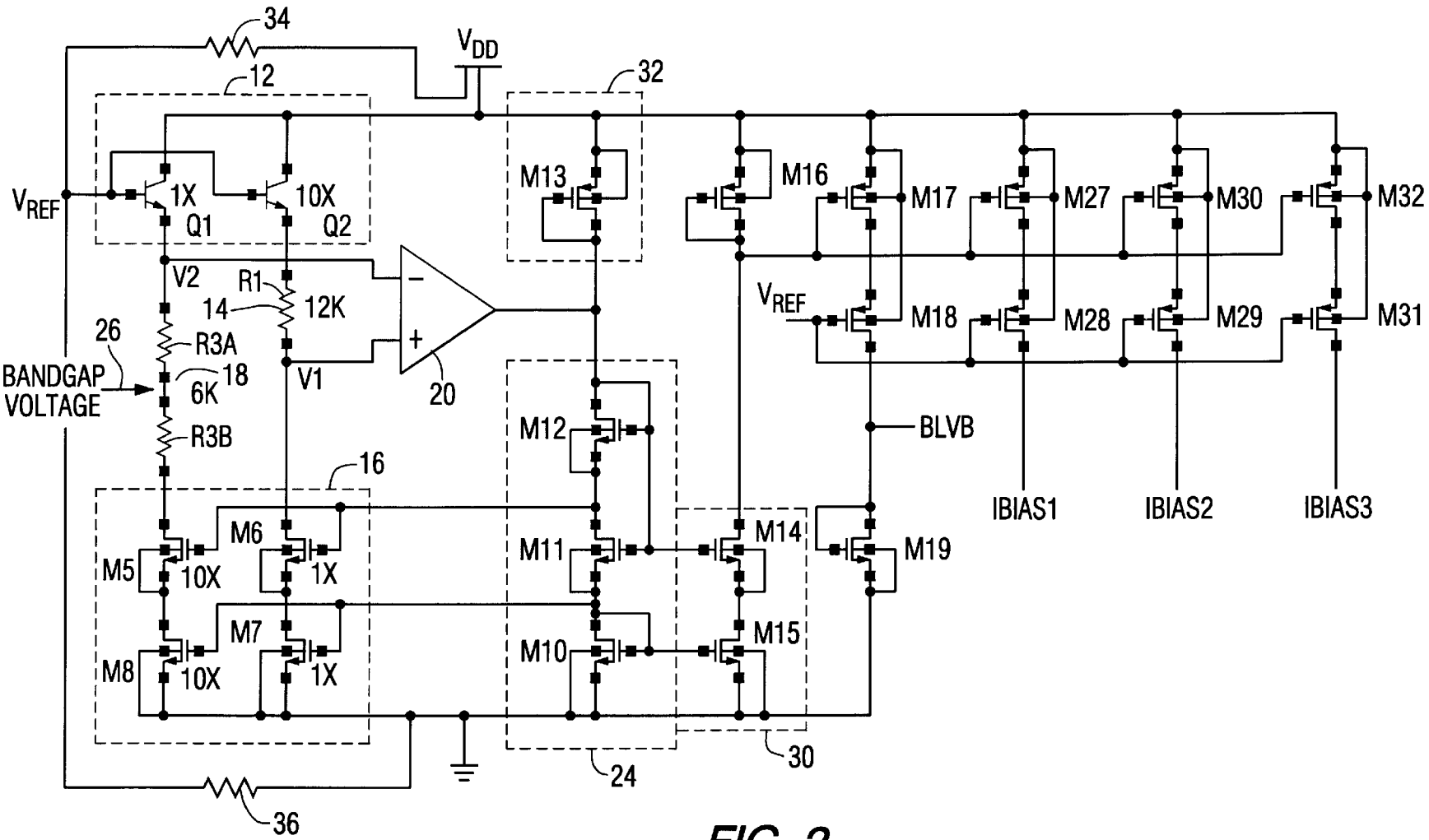
FIG. 2 is a circuit diagram of a preferred embodiment of the present invention.

A preferred embodiment of the present invention is illustrated in FIG. 2 in which numerical designations of similar features from FIG. 1 have been retained to facilitate an understanding thereof. The circuit of FIG. 2 is particularly adapted for a five volt system, and the reference voltage may be set to the half point for the power supply, namely 2.5 volts, although other voltages may be used from zero to five volts, or as appropriate for systems of other voltages. A $\Delta V_{BE}$ voltage may be generated by bipolar transistors Q1 and Q2 across resistor R1. The negative input of amplifier 20 may be connected to the emitter of transistor Q1, while the positive input of amplifier 20 may be connected to resistor R1 at an end opposite resistor R1's connection to the emitter of transistor Q2. The voltage across resistor R1 may be determined from $$\Delta V_{BE}=Vt*ln(Jc1/Jc2) \quad (1)$$

where Vt is the voltage equivalent of temperature (approximately 26 mV at 300° K.) and Jcx is the current density of transistor Qx. The sizes of transistors Q1 and Q2 may be selected to meet particular output requirements and in the embodiment of FIG. 2 transistor Q2 may be ten times larger than transistor Q1. In this particular embodiment Ic1

(the collector current of transistor Q1) may be made ten times larger than Ic2 by sizing the MOS current 10 to 1, with Jc1/Jc2 thus being equal to 100, and with $\Delta V_{BE}$ being about 120 mV.

Amplifier 20 has a feedback loop that includes control circuit 24 and current mirror 16. Control circuit 24 may include plural series connected field effect transistors (FETs) for providing control inputs to current mirror 16. In the embodiment of FIG. 2 there are three FETs, each having their gate connected to their drain. FETs M10 and M12 also have their gate connected to their source to be diode connected. FETs M11 and M12 operate together as a diode connected device.

Current mirror 16 may include two pairs of series connected FETs that each have their gate connected to their drain. The control signals for the gates may be provided from control circuit 24, such as in the manner shown. The control signal for FETs M5 and M6 may be provided from between FETs M11 and M12, and the control signal for FETs M7 and M8 may be provided from between FETs M10 and M11. This connection allows FETs M5 and M6 to remain in the high impedance mode while allowing the bandgap voltage to operate closer to ground.

The bandgap voltage may be determined from:

$$V_{BANDGAP}=V_{REF}-V_{BE1}-V_{R3A} \quad (2)$$

where $V_{BE1}$=Vt*ln(Ic1/Is1), and Is1 is proportional to the area of the emitter of transistor Q1 and Ic1=($\Delta V_{BE}$/R1)*10, where 10 is the current ratio of the bottom MOS current transistors in this embodiment, and where $V_{R3A}$=Ic1*R3A=($\Delta V_{BE}$/R1)*10*R3A.

The reference voltage may be obtained from a voltage division of supply voltage by two resistors of the same type, and thus the reference voltage has no temperature coefficient. For example, with further reference to FIG. 2 the reference voltage may be obtained with resistors 34 and 36 which divide $V_{DD}$ (the power supply voltage) to make the reference voltage, and thus the bandgap voltage, dependent on $V_{DD}$ so that the bandgap voltage can be used as a reference voltage for a semiconductor chip which is independent of temperature and which tracks power supply variations. $V_{BE1}$ has a negative temperature coefficient while VR3A has a positive temperature coefficient. Thus, the temperature effect on the bandgap voltage may be cancelled by properly sizing R3A.

In operation, if the plus terminal of amplifier 20 goes higher than the negative terminal, the output voltage of amplifier 20 would increase and the current through M10, M11, and M12 would also go up. The mirrored currents in MS, M6, M7 and M8 would also increase, increasing the voltage drop across R1. The additional drop across R1 forces the negative terminal of amplifier 20 to be the more positive terminal, decreasing the output voltage from amplifier 20. The circuit is thereby brought into equilibrium to provide a temperature insensitive bandgap voltage.

The bandgap voltage may be set as needed by dividing resistor 18 into resistors R3A and R3B and adjusting the values of the two resistors. The tap 26 may be controlled by zener zap diodes to program the desired voltage. The operating current of the system is not affected by movement of tap 26 that adjusts the bandgap voltage. The operating current is affected by the value of R1 and, in a second order, by the total value of R3, rather than the individual values of R3A and R3B.

In further embodiments, and with continued reference to FIG. 2, FETs M11 and M10 may have their current mirrored through current mirror 30 (comprising, for example, FETs M14 and M15) into a diode connected MOS device, such as FET M16. This current may be used to bias cascode configured structures, such as the combination of FETs M27 and M28. With several cascode structures attached, a bias star configuration may be generated for an entire chip.

A start-up circuit 32 may also be provided. Circuit 32 may include a FET M13 that may be a weak pull up diode. FETs M17 and M18 may form one of the cascode current sources used to self bias the bandgap. FETs M17 and M18 may be wired to a diode connected device, such as FET M19, to generate a lower bias voltage for amplifier 20.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A bandgap voltage generator comprising:

an amplifier circuit for providing a difference between two inputs, a first of said two inputs being a temperature sensitive voltage across a first resistor, and a second of said two inputs being a voltage that is a combination of a temperature sensitive voltage across a second resistor and a second voltage that offsets the temperature sensitive voltage across said second resistor;

a reference voltage circuit comprising two transistors which are operated by a reference voltage, each of said transistors for providing one of said two inputs, and two similar resistors connected to divide a power supply voltage for providing the reference voltage from between said two similar resistors so that the reference voltage is dependent on the power supply voltage and is substantially independent of temperature variations; and a feedback loop for providing an output from said amplifier to said first and second resistors, said feedback loop comprising a current mirror for providing a high impedance output to said first and second resistors and plural transistors connected between said amplifier and said current mirror for controlling operation of said current mirror.

2. The generator of claim 1 wherein said plural transistors comprise series connected field effect transistors.

3. The generator of claim 2 comprising three of said series connected field effect transistors and wherein the first and third thereof have their gates connected to their drain.

4. The generator of claim 1 wherein said current mirror comprises a first pair of series connected field effect transistors connected to said first resistor and a second pair of series connected field effect transistors connected to said second resistor, each of said field effect transistors in said first and second pairs having their gate connected to an output from, said plural series connected field effect transistors.

5. The generator of claim 1 wherein said two transistors are bipolar transistors having a common collector connected to the power supply voltage and having bases connected to the reference voltage.

6. The generator of claim 5 wherein said first resistor is connected in series with an emitter of a first of said bipolar transistors for generating a voltage/current temperature coefficient thereacross, and said second resistor is connected in series with an emitter of the second of said bipolar transistors that provides said second voltage, said second resistor being tapped for providing a bandgap voltage.

7. The generator of claim 5 wherein said reference voltage source is for providing a reference voltage between zero and five volts.

8. The generator of claim 1 further comprising a tap for tapping a selectable bandgap voltage from said second resistor.

9. A circuit for generating a bandgap voltage comprising:

two resistors connected between a first potential and a second potential for providing a reference voltage from between said two resistors so that the reference voltage is dependent on the first potential and is substantially independent of temperature variations;

a pair of bipolar transistors having a common collector connected to the first potential and having bases connected between said two resistors for receiving the reference voltage;

a first resistor connected in series with an emitter of a first of said bipolar transistors for generating a voltage/current temperature coefficient thereacross;

an amplifier having a first terminal connected to said first resistor, a second terminal connected to an emitter of a second of said bipolar transistors for sensing a difference therebetween, and an output connected between the first potential and a lower second potential;

a second resistor connected in series with an emitter of the second of said bipolar transistors, said second resistor being tapped for providing a bandgap voltage; and a feedback loop for providing an output from said amplifier to said first and second resistors, said feedback loop comprising a current mirror for providing proportional currents to said first and second resistors, and plural series connected field effect transistors connected between said amplifier and said current mirror for enabling high output impedance operation of said current mirror.

10. The circuit of claim 9 comprising three of said series connected field effect transistors that each have their gate connected to their drain, and wherein the first and third thereof have their gate connected to their source.

11. The circuit of claim 9 wherein said current mirror comprises a first pair of series connected field effect transistors connected to said first resistor and a second pair of series connected field effect transistors connected to said second resistor.

12. The circuit of claim 11 wherein each of said field effect transistors in said first and second pairs have their gate connected to an output from said plural series connected field effect transistors.

13. The circuit of claim 12 comprising three of said plural series connected field effect transistors that each have their gate connected to their drain, and wherein the first and third thereof have their gate connected to their source, and wherein a first of said field effect transistors in each of said first and second pairs have their gates connected between the first and second of said three field effect transistors.

14. The circuit of claim 11 wherein said first bipolar transistor is larger than said second bipolar transistor by a first ratio, and wherein said field effect transistors in said first pair in said current mirror are smaller than said field effect transistors in said second pair in said current mirror by said first ratio.

15. The circuit of claim 9 further comprising a start-up field effect transistor connected to the output from said amplifier for starting generation of the bandgap voltage, said start-up field effect transistor having its gate connected to its source and drain.

16. The circuit of claim 9 further comprising a second current mirror for providing a bias current from said plural series connected field effect transistors.

17. The circuit of claim 9 wherein said first potential is a power supply voltage and said second potential is ground.

18. A bandgap generator comprising:

an amplifier with a feedback loop having a high impedance output current mirror controlled by transistors connected to an output from said amplifier, said current mirror for providing proportional currents to a pair of resistors that are connected to inputs to said amplifier, a first of said inputs for receiving a temperature sensitive voltage from a first resistor, a second of said inputs for receiving a voltage that is a combination of a voltage across a second of said resistors and an offsetting voltage for cancelling a temperature variation in an output from said second resistor, said second resistor having a tap for a bandgap voltage; and a reference circuit for providing a reference voltage which is dependent on a voltage from a power supply, the reference voltage for connecting said first and second resistors to the power supply.

19. The generator of claim 18 wherein said reference circuit comprises two similar resistors for dividing the voltage from the power supply.

20. The generator of claim 18 wherein the voltage received by said second of said inputs is temperature sensitive.

21. The generator of claim 18 wherein said transistors comprise three series connected field effect transistors, each of first and third thereof having their gate connected to their drain.

22. The generator of claim 21 wherein said current mirror comprises plural first transistors having control terminals connected between first and second of said three field effect transistors and plural second transistors having control terminals connected between second and third of said three field effect transistors.

23. A bandgap voltage generator for providing a bandgap voltage to a semiconductor circuit which tracks a power supply voltage, the generator comprising:

a reference voltage circuit comprising two transistors which are operated by a reference voltage, and two similar resistors connected to divide a power supply voltage for providing the reference voltage from between said two similar resistors so that the reference voltage is dependent on the power supply voltage and is substantially independent of temperature variations;

a first resistor for providing a first temperature sensitive voltage, and a second resistor for providing a second temperature insensitive voltage, said first and second resistors connected to receive the power supply voltage though said two transistors;

an amplifier circuit for providing a difference between the first and second voltages; and a feedback loop for providing an output from said amplifier to said second resistor to make the second voltage insensitive to temperature, whereby the bandgap voltage tracks the power supply voltage and is available at said second resistor.

* * * * *